United States Patent [19]

Belles

[11] Patent Number: 4,574,745

[45] Date of Patent: Mar. 11, 1986

[54] COMPACT PULSE COMBUSTION BURNER WITH ENHANCED HEAT TRANSFER

[75] Inventor: Frank E. Belles, Cleveland, Ohio

[73] Assignee: American Gas Association, Cleveland, Ohio

[21] Appl. No.: 633,218

[22] Filed: Jul. 23, 1984

[51] Int. Cl.[4] ..... F22B 31/00

[52] U.S. Cl. ..... 122/24; 126/360 R; 431/1

[58] Field of Search ..... 431/1, 114; 60/247, 60/39.76, 39.77; 122/24; 126/360 R

[56] References Cited

U.S. PATENT DOCUMENTS 3,190,340 6/1965 Fritsch ..... 431/1

3,808,056 4/1974 Pitcher et al. ..... 431/1 X

*Primary Examiner*—Randall L. Green

*Attorney, Agent, or Firm*—Pearne, Gordon, Sessions, McCoy, Granger & Tilberry

[57] ABSTRACT

A pulse combustion burner having a multi-apertured combustion chamber wall surrounded by a primary heat transfer zone. Gas jets issuing out of the wall apertures induce high turbulence in the gas flow path through the heat transfer zone and thereby promote an exceptionally high level of heat exchange. Dimensions of the gas flow path, including the primary heat transfer zone, are arranged to cause the primary heat transfer zone to serve as an effective portion of the tailpipe of the burner. Both the high heat transfer capability and reduced tailpipe length permit reduction in the overall size of a burner unit.

6 Claims, 5 Drawing Figures

COMPACT PULSE COMBUSTION BURNER WITH ENHANCED HEAT TRANSFER

BACKGROUND OF THE INVENTION

The invention relates to combustion apparatus and more particularly to improvements in pulse combustion burners.

PRIOR ART

In pulse combustion burners of the Helmholtz type, a combustion chamber of a given size is connected to an exhaust or tailpipe of given length having a cross section somewhat less than that of the combustion chamber. An ocsillating or pulsed flow of gases through the burner is maintained by explosive combustion cycles in the chamber which by thermal expansion of the gaseous combustion products drives such products from the chamber and out of the exhaust pipe. Pulse combustion burners are generally characterized by high overall efficiency and high heat transfer characteristics. The high heat transfer properties of such burners are generally attributed to relatively high degrees of turbulence in the flow of combustion products which results from the high velocities and cyclic flow reversal of these combustion gases.

SUMMARY OF THE INVENTION

The invention provides a pulse combustion burner which has an exceptionally high heat transfer capacity in a zone associated with a combustion chamber area and thereby permits a reduction in physical size of a burner of a given heat output rating. The high heat transfer rate is achieved, in accordance with the invention, by separating flow of combustion products from the combustion chamber into a multitude of streams which individually impinge on adjacent heat transfer surface areas. The establishment of individually directed gas streams assures that a highly turbulent flow is maintained across the heat transfer surface areas of the burner and the full cross section of the cumulative flow path of such streams. Heat transfer efficiency has been observed to be more than double that of prior art pulse combustion burners.

An additional factor which contributes to a potential reduction in size of the burner is the adaptation of a heat exchange chamber into a portion of the requisite length of the tailpipe.

In the preferred embodiment, the burner combustion chamber is cylindrical and is circumferentially bounded by an apertured wall. A second wall concentrically surrounds the apertured wall and functions both as the boundary of a primary heat transfer zone and as a portion of the tailpipe length of a quasi-Helmholtz resonator. Combustion products escape radially through the apertures of the combustion chamber wall and impinge perpendicularly on the primary heat transfer wall locally creating areas of high turbulence. The individual streams eventually co-mingle and exit in a common axial flow direction. Cumulative gas flow from an upstream end of the heat exchange chamber is further agitated for high heat exchange efficiency by gas streams radially entering the downstream end of the heat exchange chamber.

The invention affords other important benefits in addition to increased heat transfer efficiency and reduced size. In a flapper valve type pulse combustion burner, the apertured combustion chamber allows the burner to be self starting, unlike prior art burners which ordinarily require start up blowers and related control circuitry. The self starting capability is thought to be the result of a tendency of the combustion gases to vary in air/fuel ratio so that there is greater certainty that a combustible mixture will be formed in the vicinity of the ignitor.

When the principles of the invention are applied to pulse combustion burners designed for aerodynamic valving, rather than flapper valving, there are advantages of noise reduction and less back flow of burned gas from the open air inlet passage. These latter advantages are achieved in addition to the earlier mentioned benefits of enhanced heat transfer and reduced size. The improved operating characteristics result from the action of the relatively small apertures in the combustion chamber wall which impede back flow and noise transmission.

DESCRIPTION OF THE PREFERRED EMBODIMENT

Figure 1:
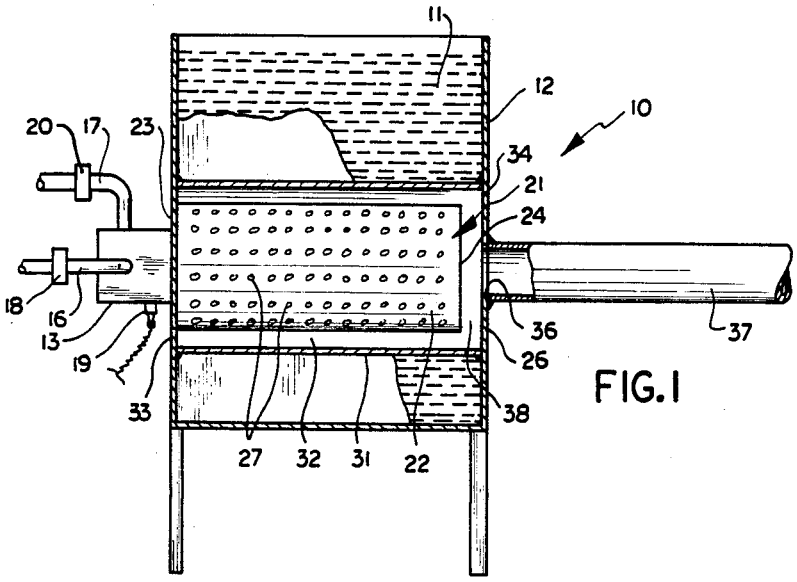
FIG. 1 is a schematic cross sectional view of a pulse combustion burner constructed in accordance with the invention and arranged to heat a surrounding tank of water.
Figure 2:
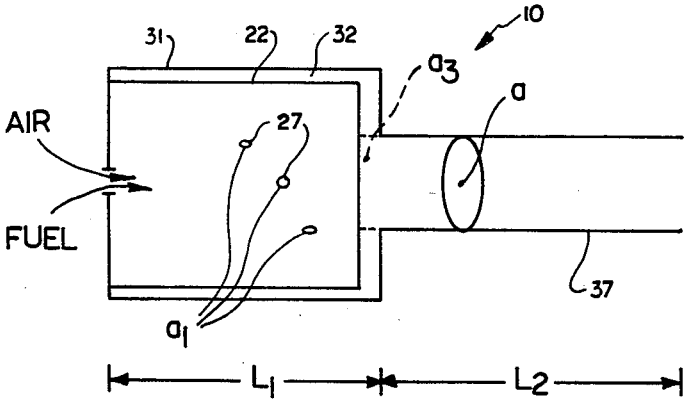
FIG. 2 is a simplified longitudinal schematic diagram of the pulse combustion burner of the invention.
Figure 3:
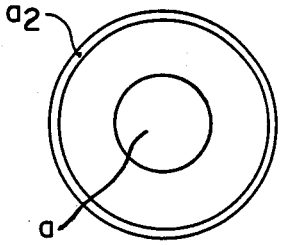
FIG. 3 is a simplified cross sectional diagram of the pulse combustion burner of the invention.

A pulse combustion burner constructed in accordance with the invention is shown in FIGS. 1–3. A burner 10 is immersed in a liquid such as water 11 contained in a tank 12. In the illustrated case, the burner 10 is generally cylindrical and has its axis arranged horizontally in the tank 12. The liquid or medium 11 in the tank 12 represents a thermal load for the burner 10 which is typical of that found in industrial, commercial and residential applications. The medium 11 being heated by the burner 10 can also be solid or gaseous and can be circulated by suitable pumps, fans or like devices to areas remote from the burner.

The burner 10 includes a mixer head 13 of generally known construction. The head 13 includes inlet lines 16, 17 for gaseous fuel such as natural gas or the like and air respectively. Flapper valves 18, 20 of known construction allow one way flow of gaseous fuel and air respectively into the mixer head 13. A suitable control valve (not shown) admits gaseous fuel to the inlet line 16 on heat demand. Similarly, an ignitor 19 such as a spark plug is energized by suitable conventional control to initiate combustion.

The burner 10 includes a cylindrical combustion chamber 21 which is connected at one end with the mixer head 13. The combustion chamber 21 is circumferentially bounded by a cylindrical shell or annulus 22. Adjacent the mixer head 13, the combustion chamber 21 is partially bounded by a wall area 23 of the tank 12 and opposite the mixer head 13, the combustion chamber 21 is bounded by an imperforate circular end wall 24 which is axially spaced from an adjacent tank wall 26.

The cylindrical wall or shell 22 is formed with a plurality of apertures 27 spaced axially and circumferentially throughout its area. In the illustrated case, the apertures 27 are circular, are of uniform size and have a depth substantially equal to the thickness of the wall 22.

Concentrically surrounding and spaced from the combustion chamber cylindrical wall 22 is an imperforate cylindrical heat exchanger wall 31. The spacing between the heat exchanger wall 31 and combustion chamber wall 21 forms an annular heat exchange zone or chamber 32. Opposite ends of the heat exchange cylinder wall 31 are closed off by wall portions 33, 34 of the tank 12. The tank wall portion 34 has a circular aperture 36 opening into a cylindrical tailpipe or exhaust conduit 37. A space 38 between the tank wall 34 and burner wall 24 provides communication between the annular heat exchange zone 32 and the tailpipe 37.

In operation, air and gaseous fuel enter the combustion chamber through the flapper valves 20, 18 into the mixer head 13. Once ignited, the gases combust in cyclic pulses. As generally known in a Helmholtz resonator, the frequency or repetition rate of these self induced pulses is interdependent on the volume of the combustion chamber and length and cross sectional area of the exhaust pipe. Positive pressure waves in the combustion chamber 21, produced in each combustion cycle, create jets of gas that are driven through the apertures 27. As described in greater detail below, the gas of these jets combines and moves axially through the annular zone 32, radially through the space 38 and axially out the tailpipe 37. The tailpipe 37 is connected to a suitable exhaust decoupler, known in the art, and vent pipe.

Figure 4:
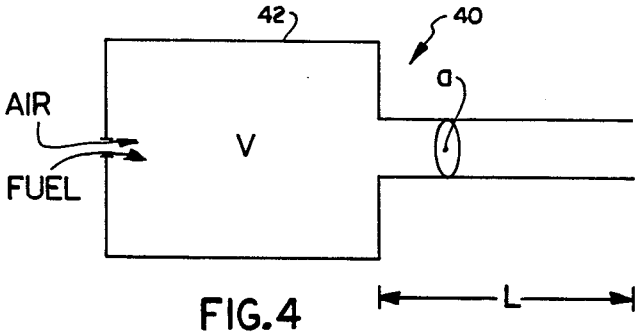
FIG.4 (PRIOR ART)
FIG. 4 is a simplified longitudinal schematic diagram of a prior art pulse combustion burner.

In a conventional Helmholtz resonator type combustion burner, such as that schematically illustrated in FIG. 4, the volume V of a combustion chamber, the cross sectional area "a" of a tailpipe and the frequency of operation primarily determine the length L of a tailpipe. In the burner 10 of the present invention, the effective tailpipe length is the combined length $L_1$ (FIG. 2) of the heat exchanger housing or wall 31 which surrounds the length of the combustion chamber 21 and the length $L_2$ of the tailpipe 37. Thus, the necessary overall length of the axial tailpipe 37 is reduced approximately by the length of the combustion chamber 21.

To promote the action of the heat exchanger zone 32 as an effective section of the total length of a tailpipe, the combined total area of the apertures 27 is generally equal to the area "a" of the tailpipe 37 and the annular cross sectional area "$a_2$" of this zone is also generally equal to the area "a" of the tailpipe 37. Similarly, a cylindrical imaginary area "$a_3$" designated by broken lines in FIG. 2, which is the transition between the radial space 38 and the tailpipe 37, is generally equal to the area "a" of the tailpipe.

The disclosed burner assembly 10 has demonstrated a remarkable increase in heat transfer capacity through the cylindrical heat exchanger wall 31 as compared to a corresponding surface 42 of the conventional pulse burner schematically illustrated in FIG. 4. For example, heat transfer ratings of 44,000 b.t.u./ft.$^2$ hour have been achieved with the burner 10 as compared to rates of 21,000 b.t.u./ft.$^2$ hour with a conventional burner 40 illustrated schematically in FIG. 4, the burner 10 of the invention and the conventional burner 40 being generally equal in size.

Figure 5:
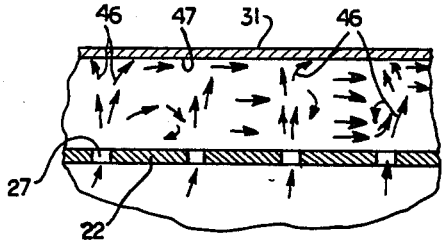
FIG. 5 is a diagrammatic view, on an enlarged scale, of a portion of a heat exchange zone of the burner of FIG. 1.

This heat transfer efficiency is the result of an extremely high turbulence in the combustion gas flow through the heat transfer zone 32. This turbulence is generated by several interacting phenomena each tending to prevent a steady state or uniform flow in the heat transfer zone 32. One disruptive condition promoting turbulent gas flow, generally characteristic of pulse combustion burners, is the pulsating net flow of gas through the burner which is associated with cyclic combustion pressure pulses. Positive pressure waves in the combustion chamber produce, in each combustion cycle, jets of gas that are driven through the apertures 27. Another factor contributing to high turbulence is the impingement of these jets, indicated by the arrows 46 radially or substantially perpendicularly against the inner surface, designated 47 of the heat exchanger wall 31. This condition is schematically illustrated in FIG. 5. Impingement of the gas jets 46 against the wall 31 tends to scatter the jets in all directions away from the wall vigorously mixing the gas and scrubbing the wall of any stationary boundary gas layer. A third factor in maintaining high turbulence and heat transfer rates is the serial arrangement of the apertures 27 along the combustion chamber 21. With this structure, as indicated in FIG. 5, the jets 46 issuing from the apertures 27 at the downstream end of the combustion chamber 21 intercept flow from the upstream end and cause such a flow to be violently agitated.

The disclosed burner 10, in addition to providing the potential for a reduction in physical size over conventional pulse combustion burners by affording higher heat exchange rates and a reduction in actual tailpipe length, affords the additional advantages of a self starting capability and a generally more stable operation. When a multiapertured combustion chamber embodying the principles of the invention is applied to an aerodynamically valved burner it will generate less noise and less back flow of burned gases from the open air inlet passage. Such a burner will also exhibit the above described enhanced heat transfer.

Although the preferred embodiment of this invention has been shown and described, it should be understood that various modifications and rearrangements of the parts may be resorted to without departing from the scope of the invention as disclosed and claimed herein.

What is claimed is:

1. A pulse combustion burner comprising a combustion chamber, inlet means for admitting a combustible gaseous mixture into the chamber and restricting reverse flow therethrough, means for igniting the gaseous mixture, a wall forming the combustion chamber, the combustion chamber wall having a multitude of spaced apertures, the combustion chamber wall restricting flow of gases from said combustion chamber to passage through said apertures, a heat exchanger wall spaced from said combustion chamber wall and forming therewith passage means for receiving gases passing through said apertures, an exhaust conduit of predetermined cross section in communication with said passage means for receiving gases passing through said apertures, the collective area of said apertures being generally matched to the cross-sectional area of the exhaust conduit, said heat exchanger wall having heat transfer surface means arranged in close proximity to the path of combustion products passing through said apertures whereby jets of gas passing through such apertures create a high degree of turbulence and resulting high heat transfer rate at said heat transfer surface means.

2. A pulse combustion burner as set forth in claim 1, wherein said apertures are arranged with respect to said heat transfer surface means to direct flow of combustion products from said combustion chamber in a direction substantially perpendicular to said heat transfer surface means.

3. A pulse combustion burner as set forth in claim 2, wherein said combustion chamber wall is generally solid and said apertures are formed as holes in such solid wall.

4. A pulse combustion burner as set forth in claim 2, wherein said combustion chamber wall and said heat transfer surface means are in spaced generally parallel relation.

5. A pulse combustion burner as set forth in claim 4, wherein said apertures and heat transfer surface means are arranged in a manner wherein combustion products, after issuing from apertures into said passage relatively remote from said exhaust conduit, are impinged by jets of combustion products issuing from apertures into said passage relatively proximal to said exhaust conduit.

6. A pulse combustion burner as set forth in claim 1, wherein the cross sectional area of said passage means is generally equal to the cross-sectional area of said exhaust conduit.

* * * * *